US006793434B1

(12) United States Patent
Olson

(10) Patent No.: US 6,793,434 B1
(45) Date of Patent: Sep. 21, 2004

(54) BRUSH

(76) Inventor: Anita D. Olson, 620 NW. 9th Ave., Grand Rapids, MI (US) 55744

( * ) Notice: Subject to any disclaimer, the term of this patent is extended or adjusted under 35 U.S.C. 154(b) by 0 days.

(21) Appl. No.: 10/616,401

(22) Filed: Jul. 9, 2003

(51) Int. Cl.[7] ..... A46B 11/04; A47L 13/22

(52) U.S. Cl. ..... 401/286; 401/282; 15/144.1; 15/144.3

(58) Field of Search ..... 401/282, 286–288, 401/290; 15/110, 144.1, 144.3, 145

(56) References Cited

U.S. PATENT DOCUMENTS

| | | | | | |
|---|---|---|---|---|---|
| 85,311 | A | | 12/1868 | Kerr et al. | |
| 358,625 | A | * | 3/1887 | Robinson | 401/288 |
| 428,410 | A | * | 5/1890 | Rich | 401/288 |
| 431,487 | A | * | 7/1890 | Ryan | 15/144.1 |
| 436,167 | A | * | 9/1890 | Biesen | 15/144.1 |
| 489,697 | A | | 1/1893 | Taylor | |
| 1,064,641 | A | | 6/1913 | Halstead | |
| 1,180,199 | A | | 4/1916 | Smith | |
| 1,375,560 | A | * | 4/1921 | Campbell | 401/291 |
| 1,515,525 | A | | 11/1924 | Stevens | |
| 1,604,435 | A | * | 10/1926 | Wharton | 601/154 |
| 1,763,832 | A | | 6/1930 | Taylor | |
| 2,887,709 | A | | 5/1959 | Carolonza | |
| 2,946,074 | A | | 7/1960 | Caldwell | |
| 2,952,027 | A | | 9/1960 | Coldwell | |
| D200,761 | S | | 4/1965 | Hamm | |
| 3,556,667 | A | | 1/1971 | Kaufman | |
| 3,597,098 | A | | 8/1971 | Kellis | |
| 4,143,667 | A | | 3/1979 | Peilet | |
| 4,237,822 | A | | 12/1980 | Kaiser, Jr. | |
| 4,312,598 | A | | 1/1982 | Vagner | |
| 4,543,913 | A | | 10/1985 | Wilkeson | |
| D285,131 | S | | 8/1986 | Wilkeson | |
| 4,617,875 | A | | 10/1986 | Holland | |
| 4,902,154 | A | * | 2/1990 | Valenza | 401/132 |
| 4,995,344 | A | | 2/1991 | Olson | |
| 6,098,233 | A | * | 8/2000 | Chen | 15/110 |

FOREIGN PATENT DOCUMENTS

| | | |
|---|---|---|
| CH | 345868 | 6/1960 |

OTHER PUBLICATIONS

Advanced Elastomer Systems: Santoprene, copy from http://www.santoprene.com/site/products/3297.html, date printed Jun. 26, 2003, 2 pages.

Material Safety Data Sheet, Santoprene ® Thermoplastic Rubber General Purpose Grades, date printed Sep. 18, 2001, 4 pages.

* cited by examiner

*Primary Examiner*—David A. Scherbel
*Assistant Examiner*—Huyen Le
(74) *Attorney, Agent, or Firm*—Patterson, Thuente, Skaar & Christensen, P.A.; Wm. Larry Alexander

(57) ABSTRACT

A brush having a brush member, and adjustable handle, and an optionally convex cover. The brush member accommodates a sponge. A first plurality of bristles extends from the brush member and each of a second plurality of orifices is disposed between the bristles, optionally in an offsetting relation. The handle extends from the brush member. The cover has a pair of slots accommodating the handle and overlays the sponge during use. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims. 37 C.F.R. § 1.72(b).

20 Claims, 5 Drawing Sheets

BRUSH

CROSS-REFERENCES TO RELATED APPLICATIONS

This application claims priority under 35 U.S.C. § 120 to, and hereby incorporates by reference, U.S. Des. application Ser. No. 29/177,252, filed Mar. 6, 2003.

BACKGROUND OF THE INVENTION

1. Field of the Invention

This invention relates to grooming and bathing aides and, in particular, this invention relates to scrubbing brushes which dispense liquids during use.

2. Background of the Invention

Bathing animals is a necessary practice to eliminate objectionable odors and to reduce the incidence of dandruff, rain rot, and other skin disorders. To this end, soaps and detergents are used to clean the animal's hair and skin and various medications are then applied. However, effectively bathing an animal requires that the entirety of the animal's hair coat be saturated. If the animal's coat is not saturated, portions thereof will not be effectively bathed and the animal's skin will not be effectively cleaned and/or medicated. The soaps, detergents, or medications enable the wash liquid to penetrate and wet the entirety of the animal's hair coat and skin.

When using bathing aides such as brushes, it is frequently necessary to apply detergents, soaps, medications, or other liquids to the brushes as the brushes are being used. Interrupting scrubbing frequently to apply these liquids is inefficient. Moreover, if animals are being bathed, the animals may become impatient and unmanageable due to these delays. To this end, reservoirs and/or sponges have been integrated into brush designs. When brushes of this design are used the brush is squeezed to force liquids out of the sponge and/or reservoir. The liquids are then usually conveyed through hollow bristles to the area being bathed. However, hollow bristles are often plugged by dirt or debris from the animal or particulates within the liquid. If a sealed reservoir is present, a suction is often generated during use, thereby preventing the liquid from exiting the reservoir for use.

There is then a need a scrub brush which will provide a liquid during bathing. There is a particular need for a scrub brush which will provide the liquid when desired without sectioning or plugging.

SUMMARY OF THE INVENTION

This invention substantially meets the aforementioned needs of the industry by providing a scrub brush which provides detergents, soaps, lotions, or other liquids during bathing but does not generate a suction or become plugged during use.

There is provided a brush of this invention, which may include a brush member, a brush cover, and an adjustable handle and is configured to be used with a sponge or the like. The brush member may include a retaining portion and a first plurality of bristles depending from the retaining portion. The retaining portion may display an upper surface and a lower surface and may define a second plurality of orifices, each of the second plurality of orifices may extend between the upper surface and the lower surface. Each of the said second plurality of orifices may optionally be interspersed between two of the first plurality of bristles, further optionally in an offsetting manner. The brush cover may be disposable over the retaining portion and may define a first and second slot. The adjustable handle may be attached to the brush member and may be accommodated through the first and second brush cover slots.

There is further provided a brush, the brush including a brush member, first and second handle members, a generally concave brush cover, and a sponge. The brush member may include a retaining portion and a first plurality of bristles extending from a lower surface of the retainer portion. Each of the first and second handle members may integrally extend from the brush member. The first handle member may reversibly and adjustably mate to the second handle member. The brush cover may define a pair of laterally disposed slots, each of the slots accommodating one of the first and second handle members. The sponge may be disposable in the retaining portion.

It is a feature of the present scrub brush to include an adjustable handle.

It is an advantage of the foregoing feature that the handle may be adjusted to snugly and comfortably fit the hand of a user.

It is another feature of the scrub brush of this invention to include a brush member retaining portion.

It is an advantage of the foregoing feature that a sponge may be retainingly accommodated within the retaining portion.

It is yet another feature of the scrub brush retaining portion of this invention to define a plurality of orifices extending between an upper surface of the retaining portion and a lower surface of the retaining portion, optionally in an offsetting relation to one or more of the bristles.

It is an advantage of the foregoing feature that the orifices are less likely to be plugged during use, therefore liquids will be dispensed more dependably and uniformly.

It is still yet another feature of the scrub brush of this invention to optionally include a plurality of projections extending from a lower surface of the present brush cover.

It is an advantage of the foregoing feature that the sponge disposed between the brush cover and partially within the retaining portion will be held more securely by the projections.

It is still yet another feature of the present invention that the retaining portion is in unsealed fluid communication with ambient air during use.

It is an advantage of the foregoing feature that use will not generate a suction or negative air pressure to inhibit the flow of expelled liquids during use.

It is still yet another feature of the present invention that the adjustable handle is accommodated within laterally opposed slots of the present brush cover.

It is an advantage of the foregoing feature that the brush cover is securely held during use when the adjustable handle is accommodated within the laterally opposed slots.

It is another advantage of the foregoing feature that a sponge disposed in the brush member retaining portion is held more securely when the adjustable handle is accommodated within the laterally opposed slots.

It is still yet another feature of the present invention that the brush cover is optionally convex, or arcuate in cross section.

It is an advantage of the foregoing feature that the brush cover conforms to a user's palm during use.

It is yet still another feature of the present brush that some embodiments are made from materials which can withstand sterilization.

It is an advantage of the foregoing feature that diseases will not be transmitted between animals because the present brush can be sterilized after use.

It is still yet another feature of the present brush that some embodiments thereof can be made from a substantially flexible material.

It is an advantage of the foregoing feature that the present brush is more effective because it can be bent during use to conform to the animal's bodily topology, such as around the animal's head, legs, and junctions of the animal's legs and body.

It is yet still another feature of the present brush to include a substantially open reservoir.

It is one advantage of the substantially open reservoir that the sponge operably disposed therein is easily accessible for replacement.

It is another advantage that the substantially open reservoir facilitates applying liquids to the sponge disposed therein.

It is still yet another feature of the present brush to include a liquid storage element, such as a sponge.

It is an advantage of the foregoing feature that sponge holds liquids in spite of the open reservoir until being compressed during use.

It is yet still another feature of the present brush to include substantially pliable bristles in at least one embodiment.

It is one advantage of the foregoing feature that the pliable bristles provide a therapeutic massage to the animal's skin during bathing.

It is a feature of the present brush that the components thereof are assembled by placing the sponge within the reservoir and securing the sponge by extending the handle through the brush cover slits.

It is one advantage of the foregoing feature that the present brush is easily assembled, used, cleaned, reassembled, and stored.

These and other objects, features, and advantages of this invention will become apparent from the description which follows, when considered in view of the accompanying drawings.

BRIEF DESCRIPTION OF THE DRAWINGS

This invention relates to, and can be further described with reference to, the accompanying drawings, wherein like reference numerals refer to like parts in the several views.

Figure 1:
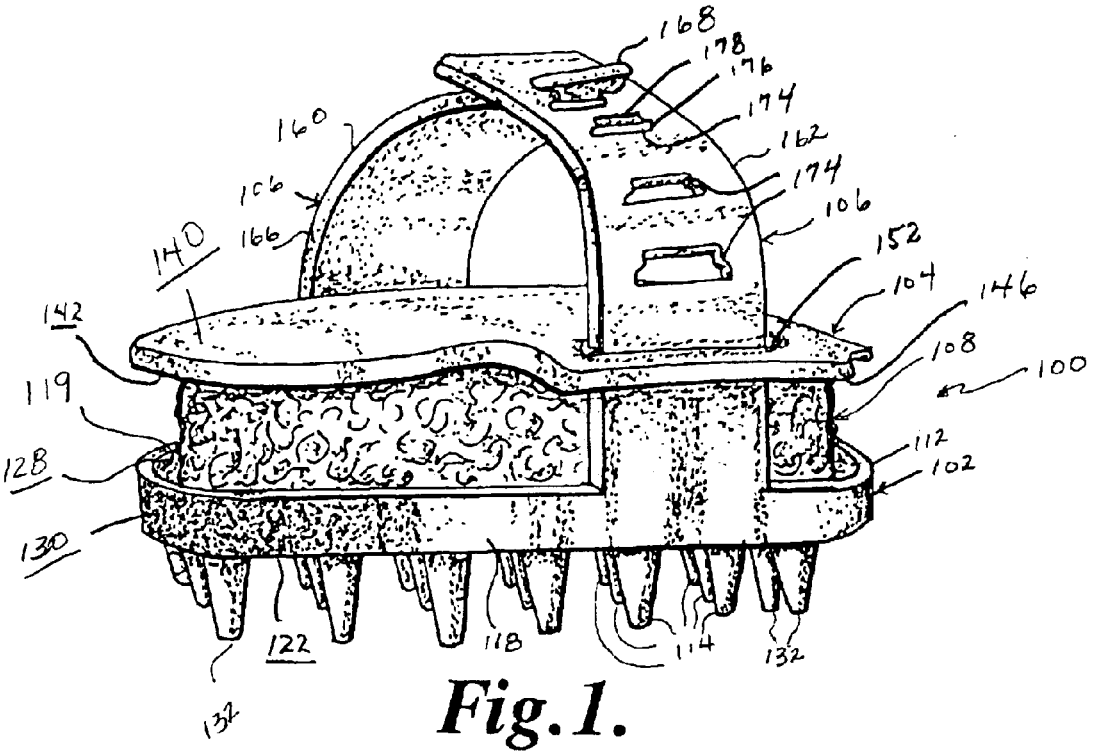
FIG. 1 is a perspective view of one embodiment of the scrub brush of this invention.
Figure 2:
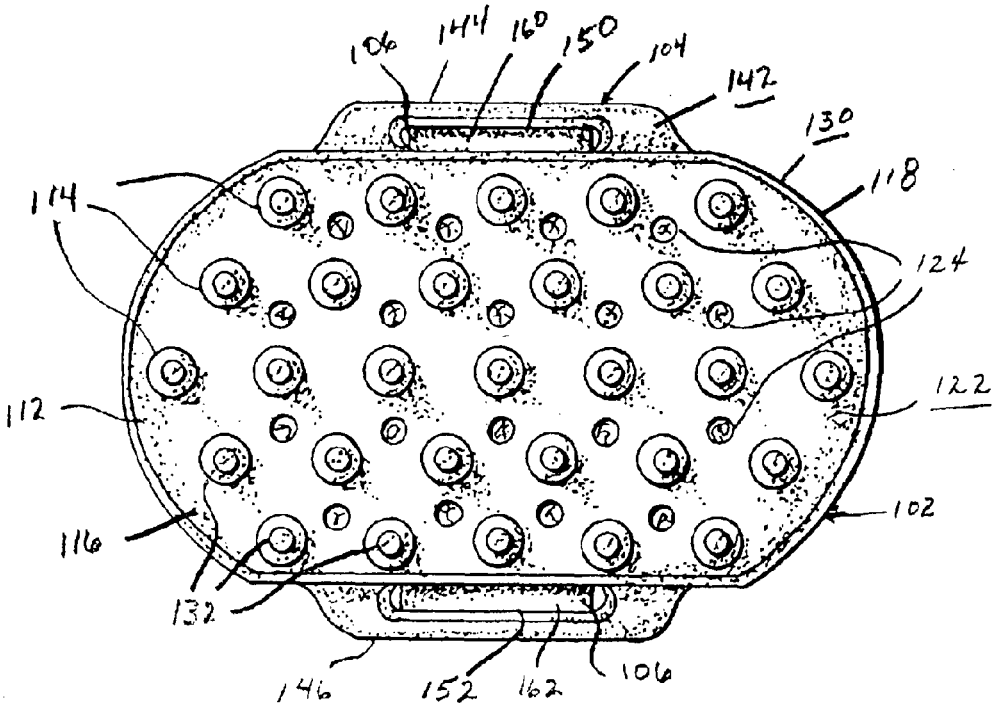
FIG. 2 is a bottom view of the scrub brush of FIG. 1.
Figure 3:
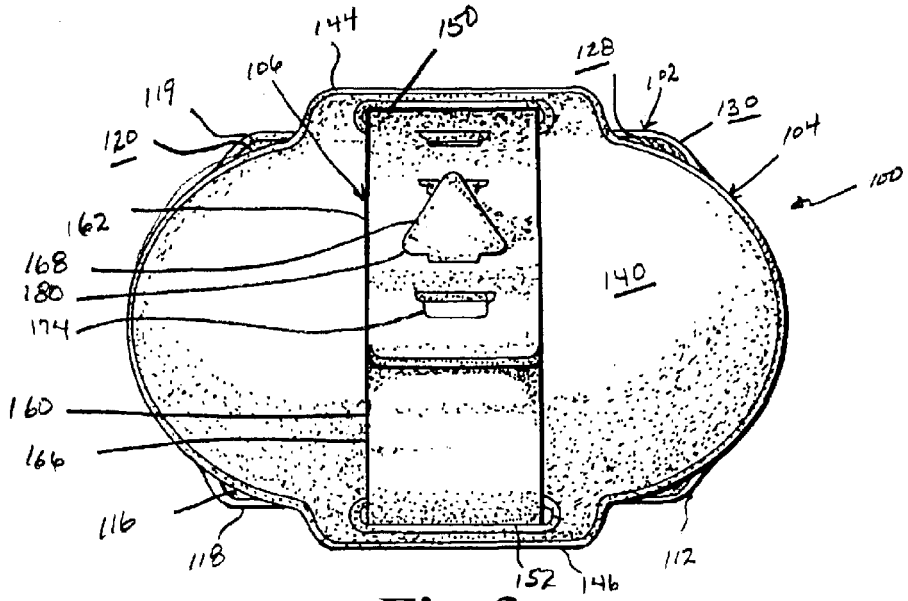
FIG. 3 is a top view of the scrub brush of FIG. 1.
Figure 4:
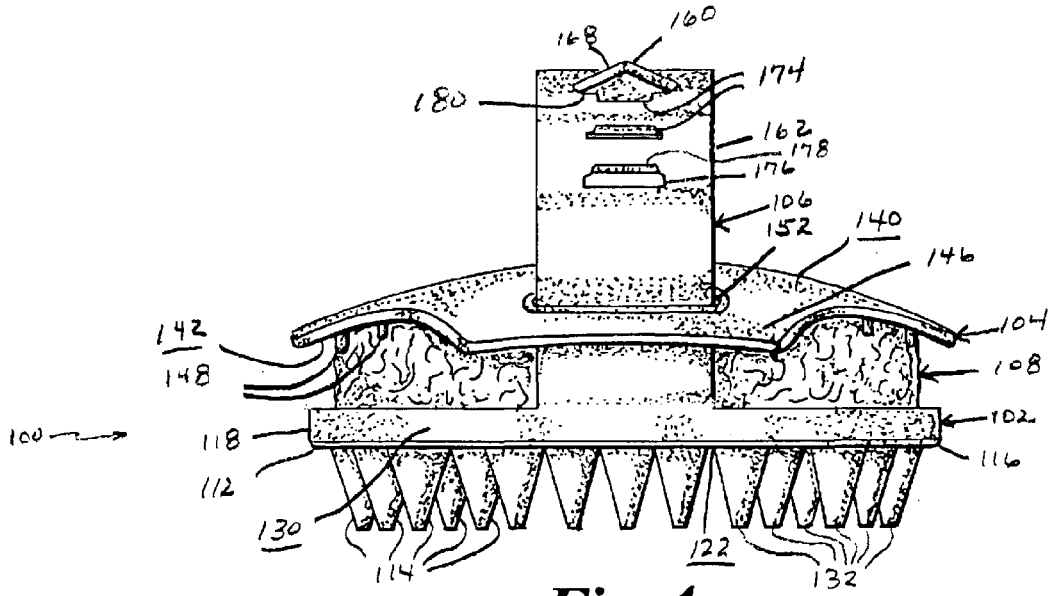
FIG. 4 is a longitudinal view of the scrub brush of FIG. 1.
Figure 5:
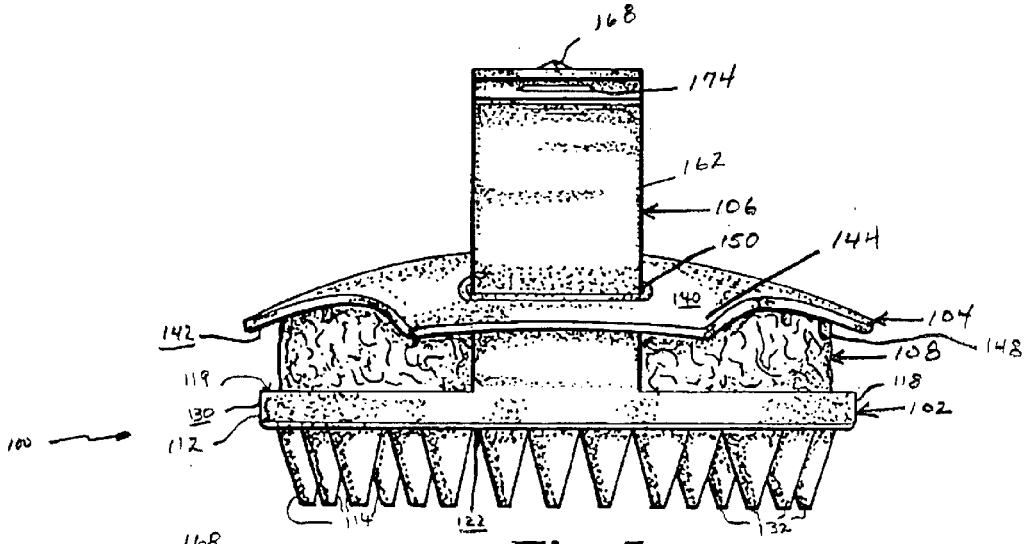
FIG. 5 is an opposite longitudinal view of the scrub brush of FIG. 1 as depicted in FIG. 4.
Figure 6:
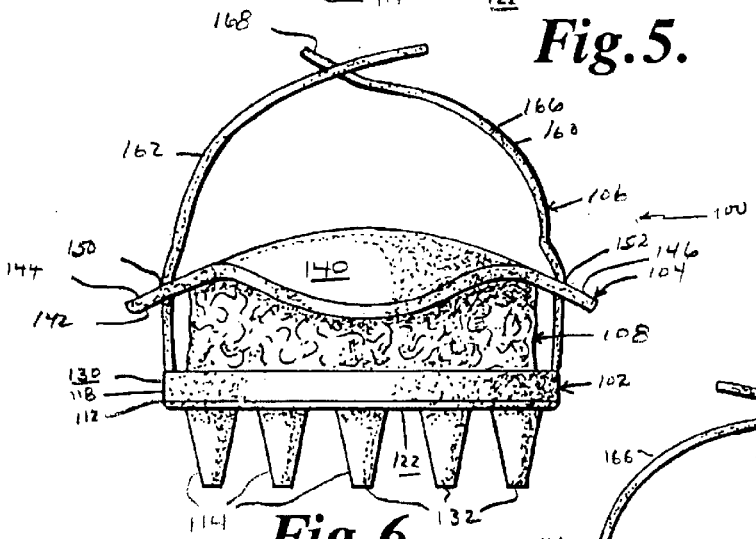
FIG. 6 is a side view of the scrub brush of FIG. 1.
Figure 7:
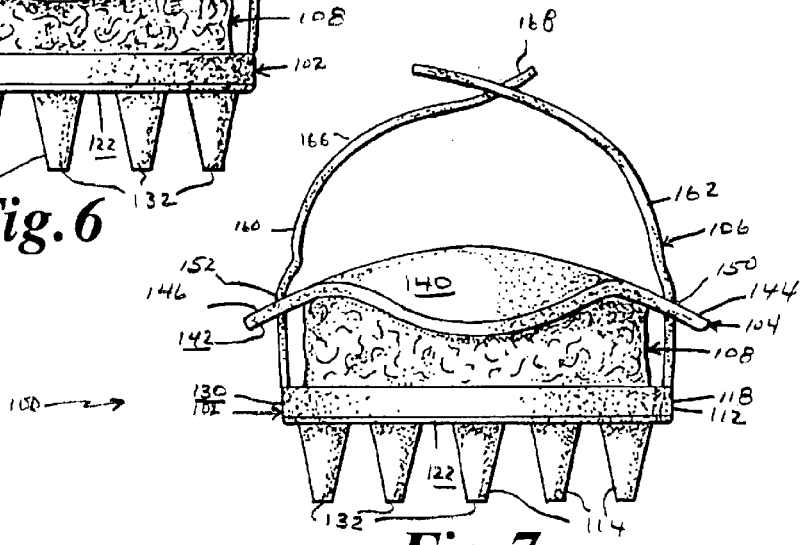
FIG. 7 is an opposite side view of the scrub brush of FIG. 1 as depicted in FIG. 6.
Figure 8:
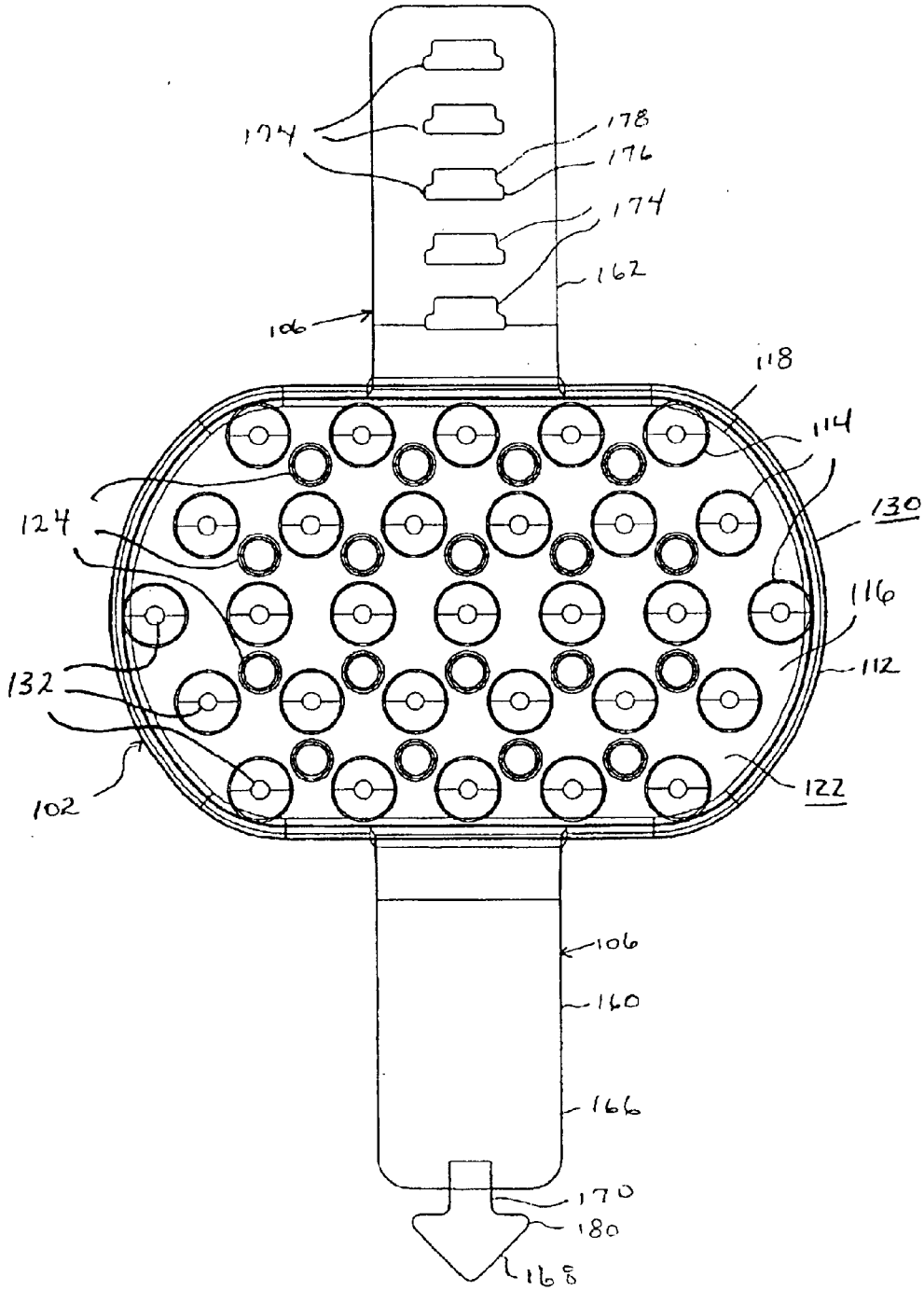
FIG. 8 is a plan view of the scrub brush member of FIG. 1.
Figure 9:
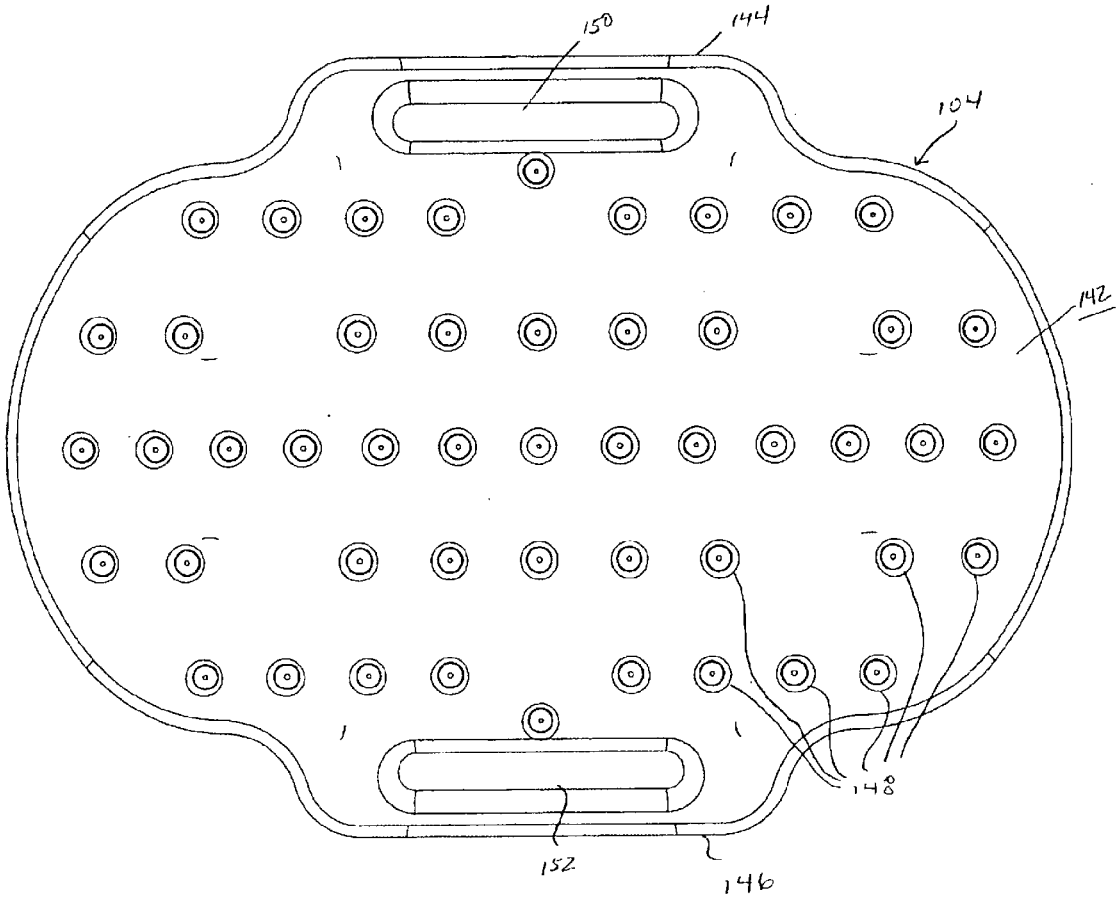
FIG. 9 is a bottom view of the scrub brush cover of FIG. 1.

It is understood that the above-described FIGS. are only illustrative of the present invention and are not contemplated to limit the scope thereof.

DETAILED DESCRIPTION

Any references to such relative terms as front and back, right and left, top and bottom, upper and lower, horizontal and vertical, or the like, are intended for convenience of description and are not intended to limit the present invention or its components to any one positional or spatial orientation.

Unless otherwise defined, all technical and scientific terms used herein have the same meaning as commonly understood by one of ordinary skill in the art to which this invention belongs. Although methods and materials similar or equivalent to those described herein can be used to practice the invention, suitable methods and materials are described below. All publications, patent applications, patents, and other documents mentioned herein are incorporated by reference in their entirety. In case of conflict, the present specification, including definitions, will control. In addition, the materials, methods, and examples are illustrative only and not intended to be limiting.

Each of the additional features and methods disclosed herein may be utilized separately or in conjunction with other features and methods to provide improved brushes and methods for making the same. Representative examples of the teachings of the present invention, which examples utilize many of these additional features and methods in conjunction, will now be described in detail with reference to the drawings. This detailed description is merely intended to teach a person of skill in the art further details for practicing preferred aspects of the present teachings and is not intended to limit the scope of the invention. Therefore, specific combinations of features and methods disclosed in the following detailed description may not be necessary to practice the invention in its broadest sense, and are instead taught merely to particularly describe representative embodiments of the invention.

U.S. Des. Pat. No. 200,761, issued to Hamm on Apr. 6, 1965, describes a shampoo dispensing brush. The brush has bristles and a cavity. The cavity can be completely enclosed. A pathway extends from the cavity through several of the bristles.

U.S. Des. Pat. No. 285,131, issued to Wilkeson on Aug. 12, 1986, describes a combined applicator and grooming brush for animals. The combined applicator and grooming brush has an adjustable handle, which is attachable to a base of the brush. A completely closable reservoir is present in the brush base.

U.S. Pat. No. 85,311, issued to Kerr et al. on Dec. 29, 1868, describes a fountain comb for dyeing, oiling, or dressing human hair. The invention includes a hollow comb capable of containing liquid. The comb teeth are disclosed as "faraminous or punctured" in order to allow the liquid to ooze from the teeth in small quantities. An elastic bulb is present within the comb hollow to hold the liquid, until the liquid is expelled therefrom.

U.S. Pat. No. 489,697, issued Jan. 10, 1893 to Taylor, describes a substitute for sponges, brushes, and the like. The device includes a hollow vessel constructed of india-rubber or other suitable elastic or yielding material. The hollow vessel forms a completely enclosed reservoir. A portion of the surface of the substitute is formed with a number of ribs, ridges, or other suitable projections. The lower edges of the ridges are notched or serrated to admit air. A number of small holes are present between each of the ridges. The device may be squeezed or otherwise compressed and inserted into water or another liquid, then allowed to draw in a quantity of the liquid as the device returns to its "normal" configuration. Thus charged, the device may be squeezed to eject a shower of liquid. U.S. Pat. No. 1,064,641, issued in June 1913 to Halstead, describes a bath brush which is flexible, will fit the hand of a user and will hold water or other liquid until the brush is applied. The brush provides a hollow body portion comprising a top, a bottom, and sides. The sides are of greater thickness than the top and bottom in order to support the top from the bottom. The body is formed of flexible material, preferably rubber, and is formed integral with the bottom perforated teeth. Secured to the bottom of the body is a flange member preferably formed of sponge rubber. The flange is of the same thickness as the length of the teeth to prevent the water or other liquid from splashing when the brush is being used. An opening is formed in the top of the brush for filling the brush. The opening is closed by a cap. Straps are provided to secure the brush to the hand of a user, the hands of the strap secured by a fastener.

U.S. Pat. No. 1,180,199, issued to Smith on Apr. 18, 1916, describes a fountain comb. The fountain comb includes a fluid receptacle shown in the form of an elongated comparatively flat casing. The casing has a lower side with a plurality of perforations from which a series of fluid-distributing members project. The members are disclosed in the form of comb teeth, but are also described as bristles if the device is a brush. The device is further described as having a lid which, when closed, is disposed in fluid-tight contact with the upper side of the receptacle to prevent the escape of fluid placed therein.

U.S. Pat. No. 1,515,525, issued Nov. 11, 1924 to Stevens, discloses a massage comb. The comb includes a body, a cap, means for holding a cleansing or medicinal preparation, and a follower for forcing the preparation from the body. The body includes a disk-shaped lower wall and an upstanding sidewall, which may be provided with external screw threads. The lower end of the sidewall is provided with a shoulder on which the cap is adapted to rest. Comb teeth depend from the disk-shaped wall and the sidewall. The comb teeth are disposed in an annular formation and have "ways" extending therethrough communicating with the body or the chamber formed by the disk-shaped wall and the sidewall and through which the liquid preparation can be dispensed.

U.S. Pat. No. 1,763,832, issued May 11, 1929 to Taylor, discloses a scalp treating brush. The brush has a body portion preferably oval in formation. The body portion is hollow, providing a reservoir to contain liquids such as tonic, bay rum, or the like used in treating the scalp. A partition connects the side walls of the reservoir dividing the body portion into lateral compartments. The bottom of the brush is provided with openings arranged at predetermined points to accommodate the bristles. The bristles are disposed adjacent to one of the compartments so that liquid passing from the compartment may be picked up by the bristles and spread through the hair. Openings are formed in the bottom and provide means to allow the liquid in the compartment to pass therefrom. A rotary valve member with a series of openings and positioned within one of the compartments is provided so that when the openings of the valve member are brought into registry with the openings in the brush bottom, the liquid in the compartment passes therefrom.

U.S. Pat. No. 2,887,709, issued May 26, 1959 to Carolonza, discloses a scrubbing brush with cleaning detergent. The brush is provided with a rectangular baseplate of molded plastic and has bristles depending from the baseplate. A generally spherically-shaped, downwardly opening, resiliently deformable hollow body has a flanged lower end adapted to removably engage in an upwardly opening, annular groove or seat of the baseplate. The body is formed of a resiliently deformable material such as a thick soft rubber or polyethylene plastic. The body receives a spongy filler piece, which substantially entirely fills the interior of the body. An open space is left between the top surface of the baseplate and the bottom surface of the filler piece. A center opening is formed in the upper hand of the body. The center opening is adapted to receive a hollow center post or core having a rounded head at an upper hand formed with a threaded center opening and adapted to receive the threaded shank of the filler plug. A concentrated soap or detergent can be deposited in the core through the opening. When desired, a downward axial pressure is exerted on the post to force the slits to open. The axial compression of the post causes ejection of liquid through the slits.

U.S. Pat. No. 2,946,074, issued Jul. 26, 1960 to Caldwell, discloses a bathing accessory having a container of polystyrene or a like flexible material. The container has a bottom wall and side walls. Brush elements extend downward from the bottom wall and are formed integrally with the bottom wall. Small apertures are formed between the brush elements in the bottom wall. A sponge clement having a wide base and a securing strip is present. Small rectangular apertures are punched or cut out of the sponge element.

U.S. Pat. No. 3,556,667, issued to Kaufman on Jan. 19, 1971, discloses scrubbing implements for cleansing by scrubbing with the use of a cleansing compound. The cleansing compound is provided within a dispensing type reservoir, whereby pressure on the container or a foam block will dispense the cleansing compound outwardly and onto the scrubbing means. The foam block or container may be either permanently associated with the scrubbing means or may be replaceably associated therewith to enable retention of the scrubbing means with replacement of the container or block. The implement is preferably furnished with protective covering means during transport, storage, and prior to use thereof, such as a peelable or strippable layer of waterproof adhesively secured material or a layer of water soluble material. The implement may further preferably comprise means for dispensing the cleansing compound to the bristles, as by a plurality of apertures extending between the reservoir and the bristles.

U.S. Pat. No. 3,597,098, issued to Kellis on Aug. 3, 1971, discloses a squeeze brush with rotary dispenser. The brush includes a resilient dome having inwardly extending peripheral flanges about the bottom open end. The flanges define an annular inner groove within which there is disposed a substantially rigid rotary plate having bristles or the like depending therefrom and fitting within the groove in rotatably slidable relation thereto. The lower flange of the resilient dome extends further inwardly than the upper flange and is provided with at least one aperture therethrough adapted to mate with one or more apertures in the rotary plate as the rotary plate is rotated in the dome to align the apertures. The resiliency of the dome allows the dome to be compressed to force material from the interior thereof through the aligned apertures of the dome flange and the rotary plate.

U.S. Pat. No. 4,143,667, issued on Mar. 13, 1979 to Peilet, discloses a retractable dispensing brush. The material to be dispensed is held in a container, which is mounted on a rear side of the brush. A disengageable coupling is provided between the container and a passage extending through an axial member to the front of the brush.

U.S. Pat. No. 4,237,822, issued on Dec. 9, 1980 to Kaiser, discloses an animal medication brush. The animal medication brush is provided with a hollow body containing a liquid medication. Detachably mounted on the bottom of the body is a hollow head communicating with a plurality of depending elongated hollow teeth. Enclosed within the hollow body is a pump manually operated by a lever on the side of the brush handle for forcing the liquid medication into the hollow head and out the hollow teeth in a controlled manner.

U.S. Pat. No. 4,312,598, issued Jan. 26, 1982 to Vagner, discloses a household appliance for cleaning floors, windows and other washable surfaces. The appliance includes a handle at one end and which is hinged to a heating sole protected by a cover. A swab is used in combination with the foregoing handle and heating sole, the swab made from any absorbing material. The swab is held under the heating sole for feeding water to a lower face of the heating plate in contact with the swab. The heating sole protecting cover assembly has at least one opening and, with the water feeding means, forms a water reservoir placed above the cover. The water reservoir includes at least one appendage housed in the opening. The appendage has at least one flow orifice at its base. Means such as a piston and springs are provided for maintaining the orifice in a normally closed position and for opening the orifice when it is desired to dampen the swab in contact with the heating sole.

U.S. Pat. No. 4,543,913 issued Oct. 1, 1985 to Wilkeson, discloses a liquid dispenser and grooming brush for animals. Using the brush, a free-flowing liquid can be applied to the skin of an animal, the liquid being contained in a chamber having a first plurality of generally flexible, solid members extending normally from a bottom wall thereof and arranged in spaced relation to each other for combing and separating the hair of the animal and a second plurality of generally flexible, hollow members also extending normally from the bottom wall of the chamber and communicating therewith. The free ends of each plurality of members terminate in a common plane. Each member of the second plurality is provided with a self-sealing slit adjacent its free end, the slits opening when the dispenser is moved in one of two opposed directions, the free ends in contact with the skin of the animal and with a downwardly applied pressure to the dispenser sufficient to open the slits to emit the liquid.

U.S. Pat. No. 4,617,875, issued Oct. 21, 1986 to Holland, discloses a grooming and treatment applicator. The applicator includes a circular housing for containing a liquid or powder, the housing also including a flat circular face with a peripheral lip and several spaced openings extending through the face. Alternative applicator faceplates or heads are provided, each having a brush, sponge, or other similar surface, the faceplates carrying nozzles extending for a distance substantially equal to the extremity of the brush or sponge and overlying the spaced openings. The nozzles may be selectively sealed or opened to mate with the opening in the housings by rotation of the faceplates using an actuator lever. Arrangements are provided for rotatably and removably holding the faceplates or heads onto the housing, for securing a strap to the housing for extending around the back of a person's hands, and for filling the housing with fluid or powder.

U.S. Pat. No. 4,902,154, issued Feb. 20, 1990 to Valenza, discloses a dispensing brush with barb means to rupture material packet and in which a material dispensing brush, such as a veterinary brush having material to be dispensed, such as flea powder, is contained in the brush body and is either automatically or manually releasable through hollow brush bristles.

U.S. Pat. No. 4,995,344, issued to Olson on Feb. 26, 1991, discloses an apparatus for cleaning with an aqueous solution. The apparatus includes a cover with a handle and a tubular section, a perforate scrubbing platen with a finger or sponge or abrasive or other structure to contact the mammal or an object, a scrubbing compound holder between the cover and platen, and a central scrubbing drive strut and socket structure that enables the platen to move toward the cover to expelled scrubbing compound during use and to move away from the cover during use to intake diluent.

As will be shown infra, none of the foregoing devices combines the advantageous features found in the present brush. Moreover, none of the foregoing devices is as easily assembled, used, disassembled, cleaned, and stored as is the present scrubbing brush. Additionally, none of the foregoing devices dispenses liquids without plugging, hence cleans as well as the brush of this invention.

While the present brush is described with respect to bathing, grooming and medicating animals, it should be understood that embodiments of the present brush may also be used by persons during grooming, bathing, and medicating as well. Obviously, a person of ordinary skill in the art would recognize that the present brush may be used without liquid to brush or curry the hair or fur of animals. Referring to the FIGS., one embodiment of the brush of this invention is depicted generally at 100. The brush 100 includes a brush member 102, a brush cover 104, a strap or handle 106, and a sponge 108.

The brush member 102 may include a retaining portion 112 and a plurality of bristles 114. In the embodiment depicted, the brush member 102 is substantially unitary, or otherwise integral. However, brush members having separately formed and/or equivalently functioning elements are contemplated to be within the spirit and scope of this invention. The retaining portion 112 may include a generally planar member 116 and a generally vertical member 118. In the embodiment depicted, the vertical member 118 extends from a periphery of the horizontal member 116. The vertical member 118 cooperates with the horizontal member 116 to define a reservoir 119 and so as to retain the sponge 108 in the reservoir 119 during use. The horizontal member 116 displays an upper surface 120 (not shown) and a lower surface 122. In this embodiment, the horizontal member upper surface 120 is substantially smooth. However, one or more projections may extend from the horizontal member upper surface 120 in other embodiments so as to aid in retaining the sponge 108 within the reservoir 119 during use. A plurality of orifices 124 are defined in the horizontal member 116 so as to extend between respective upper and lower surfaces 120 and 122. The vertical member 118 displays an inner surface 128 and an outer surface 130. In the embodiment depicted, the reservoir 119 may be considered to be bounded by the horizontal member upper surface 120 and the vertical member inner surface 128. The orifices 124 fluidly communicate the reservoir 119 and an area external to the brush 100 proximate the bristles 114, thereby allowing fluid egress from the reservoir 119. In the embodiment depicted, the bristles 114 extend generally normally (or orthogonally) from the horizontal member lower surface 122 and terminate in substantially blunt tips 132. However, the tips 132 may have any of several geometries, including slanted, pointed, or the like. The bristles 114 are variable as to number, length, and diameter in the context of the present invention. Specific numbers, lengths, and diameters being determined by such factors as the length, texture, and amount of hair present on an animal or person to be bathed or groomed.

The brush cover 104 displays an upper surface 140 and a lower surface 142 and may include generally opposed lateral lobes 144 and 146. In the embodiment depicted, the brush cover upper surface 140 is substantially smooth. In contrast to the brush cover upper surface 140, an optional plurality of projections 148 may extend from the brush cover lower surface 142. The projections 148, if present, function to retain the sponge 108 in the reservoir 119. Slots 150 and 152 are defined in the respective lobes 144 and 146. As can be seen, the brush cover 104 has a generally concave configuration in the embodiment depicted. That is the present brush cover may be generally arcuate in cross section. The generally concave configuration may advantageously conform to a user's palm during use. The brush cover 104 may be made from materials with sufficient tack so as to prevent slipping from a user's hand, even when materials are present which would ordinarily cause the brush cover 104 to be slippery, e.g., soaps and detergents.

The handle 106 in the embodiment depicted is constructed so as to closely fit a variety of hand sizes. In the embodiment shown, the handle 106 includes respective first and second handle members 160 and 162. The first and second handle members 160 and 162 may unitarily, or otherwise integrally extend from the retaining portion vertical member 118 and are dimensioned so as to be accommodated within the slots 150 and 152 of the brush cover 104. The handle member 160 has a main portion 166 and an arrow-shaped tip 168. However, the shape of the tip may be in other geometries as well. The main portion 166 and tip 168 are connected by a connector portion 170. The second handle member 162 defines a plurality of slots 174. Each of the slots 174 includes adjoining respective proximal and distal portions 176 and 178, the distal portion 178 being narrower than the proximal portion 176 in some embodiments. The tip 168 may have a portion 180, which is broader then the openings defined by either of the proximal or distal portions 176 and 180. The handle members 160 and 162 may be made from an elastomer so that the tip 168 will be sufficiently flexible to be forced into one of the slots 174. Additionally, the material from which the handle member 162 is made may be sufficiently elastic so as to allow the openings defined by the slots 174 to distort or stretch when the tip 168 is being forced thereinto.

The sponge 108 is dimensioned to fit within the reservoir 119 so that an upper portion of the sponge 108 is visible when the cover 104 is in place over the sponge 108. The present sponge may be made from a material known to persons of ordinary skill in the art as a "tack sponge." The tack sponge of some embodiments may be capable of withstanding sterilization. However, any materials which can store and dispense liquids may be used in some embodiments of the present invention. These materials may include natural sponges, porous synthetic resins, natural and synthetic rubbers, or celluloses.

With the exception of the sponge 108, a thermal plastic elastomer, such as Santopreneg®, has been a satisfactory material used in manufacturing the present brush. However, other materials such as vulcanized rubber, EPDM rubber compounds, and polychloroprene rubber compounds may be acceptable for other embodiments. Additionally, a person of ordinary skill in the art can select materials with the desired degree of flexibility and durometer without undue experimentation from sources such as the Handbook of Plastics, Elastomers, and Composites, Charles A. Harper, Editor-in-Chief, Third Edition, McGrawHill, New York (1996). With the exception of the sponge, the components of the present brush may be manufactured by such methods as injection molding, in which the present brush member and handle are formed in a single piece. However, a person of ordinary skill in the art will readily recognize that other methods may be used as well. Moreover, many of the components may be separately manufactured and attached to make embodiments with varying degrees of flexibility and durometer. Because varying degrees of stiffness may be desirable, the present brush may be made from materials imparting a specific durometer. In one embodiment, it has been found that Shore A durometers of 50, 60, and 65 have produced brushes with bristles respectively characterized as "soft," "medium," and "firm." Brushes with these durometers have been desirable for bathing animals having differing hair lengths, textures, and amounts (depths). Therefore, it is contemplated that some embodiments of the present brush will have Shore A durometers between about 30 and 85, between about 40 and 75, or between about 10 and 65.

In use, the sponge 108 is exposed to a liquid such as water. Other materials, such as soaps, detergents, pesticides, lotions, repellents, medications, and the like, may optionally be dissolved or suspended in the water. When a sufficient amount of the liquid is present within the sponge 108, the sponge 108 is placed in the reservoir 119 and secured in place by placing the brush cover 104 over the sponge 108 such that the projections 148 contact the sponge 108. In this manner the liquids within the sponge 108 are free to be forced from the sponge and flow through the orifices 124 free from restraints imposed by completely enclosed reservoirs. These restraints are predominantly imposed by partial vacuums present in the reservoirs of enclosed containers, which tend to retain the liquid within the reservoirs and prevent the liquid from egressing from the reservoirs through the orifices. The brush cover projections 148 are pressed against the sponge 108 by forces exerted by the user's hand and, thereby, aid in retaining the sponge 108 within the reservoir 119. The handle 106 is then adjusted to snugly fit around the user's hand by forcing the tip 168 through one of the slots 174. The tip 168 is forced through one of the slot proximal portions 176 so as to adjust the handle 106 to snugly fit about the user's hand. The tip 168 is retained in this position by a contacting relation with the second handle member 162, the connector portion 170 being accommodated in the distal portion 178. While using the brush to bathe the animal, pressure from the user's hand is exerted on the brush cover 104, thereby expelling liquid from the sponge 108. The expelled liquid is retained within the reservoir 119 so as not to spill over the top of the vertical member 118, but flows through the orifices 124, where the liquid contacts the animal being bathed. After being used, the present brush is easily disassembled by pulling the tip 168 through the slot 174, removing the handle members 160 and 162 from the slots 150 and 152, and removing the sponge from the reservoir 119. Thus disassembled, the components of the present brush can be easily cleaned, sterilized, and dried, then reassembled for storage.

Many brushes of the prior art include orifices extending through the bristles. However, orifices extending through the bristles are easily plugged during use. In contrast to many similar brushes, the present orifices are disposed in an offsetting relationship to the bristles 114, wherein each orifice extends between the upper and lower surfaces of the brush horizontal member 116. Each orifice is also optionally disposed between two adjacent bristles. However, the distribution and disposition of these orifices may vary according to such factors as the amount and distribution of liquids to be dispensed, user desires, or the like. Orifices constructed in this manner are less inclined to be plugged during use. Other brushes of the prior art include structures substantially enclosing the reservoirs thereof. It has been found that it is difficult to expel liquids from brushes of this nature because of the suction generated when the flexible materials rebound to their original configuration after being compressed to expel the liquid therewithin. The suction generated during use tends to retain liquids within the reservoirs, rather than allowing the liquids to be expelled from the reservoirs during bathing. In contrast to many devices of the prior art, the sponge within the present brush is partially exposed to ambient atmospheric pressures during use, thereby preventing suction from being generated and allowing liquids expelled from the sponge to freely flow out of the reservoir through the orifices.

Because numerous modifications of this invention may be made without departing from the spirit thereof, the scope of the invention is not to be limited to the embodiments illustrated and described. Rather, the scope of the invention is to be determined by the appended claims and their equivalents.

What is claimed is:

1. A brush, comprising:

a brush member comprising a retaining portion and a first plurality of bristles depending from the retaining portion, the retaining portion displaying an upper surface and a lower surface and defining a second plurality of orifices extending between the upper surface and the lower surface, at least one of said second plurality of orifices disposed between two of said first plurality of bristles;

a brush cover disposable over the retaining portion and defining a first and a second slot; and an adjustable handle attached to the brush member and accommodated through the first and second brush cover slots.

2. The brush of claim 1, in which each of the first plurality of bristles are unitary with the retaining portion.

3. The brush of claim 1, in which each of the first plurality of bristles are substantially flexible.

4. The brush of claim 1, in which the brush member is substantially flexible.

5. The brush of claim 1, in which the brush member retaining portion defines a reservoir.

6. The brush of claim 5, further comprising a sponge disposable in the reservoir, the reservoir in unsealed fluid communication with ambient air when the sponge is disposed in the reservoir and the brush cover is disposed over the sponge.

7. The brush of claim 1, the brush cover displaying an inner surface and further comprising a third plurality of projections extending from the brush cover inner surface.

8. The brush of claim 1, in which the brush cover is generally convex.

9. The brush of claim 1, the handle comprising a first handle member and a second handle member, the first handle member adjustably and reversibly attaching to the second handle member.

10. The brush of claim 9, the first handle member comprising a main portion, a connector portion extending from the main portion and a tip extending from the connector portion, the second handle member defining a third plurality of slots, the first handle member attaching to the second handle member by extending the tip through one of said third plurality of slots.

11. The brush of claim 1, in which each of said first plurality of bristles is characterized by a Shore A durometer between about 30 and 85, between about 40 and 75, or between about 10 and 65.

12. A process of making a brush, comprising:

forming a brush member having a retaining portion with an upper surface and a lower surface, a first plurality of bristles extending from the lower surface, and defining a second plurality of orifices extending between the upper and lower surfaces;

forming an adjustable handle attachable to the brush member, and forming a brush cover with a pair of laterally disposed slots accommodating the handle, the brush member defining a reservoir in unsealed fluid communication with ambient air when the brush member is disposed over the brush member during use.

13. The process of claim 12, in which the brush member and the handle are unitarilly formed.

14. The process of claim 13, in which the brush member and the handle are formed by injection molding.

15. The process of claim 12, further comprising providing a sponge disposable in the reservoir.

16. The process of claim 12, in which the brush cover displays an upper surface and a lower surface and in which the brush cover is formed having a substantially smooth upper surface and a plurality of projections extending from the lower surface.

17. The process of claim 12, in which the brush cover is formed such that the brush cover is generally convex.

18. The process of claim 12, in which at least a portion of the brush member is characterized by a Shore A durometer between about 30 and 85, between about 40 and 75, or between about 10 and 65.

19. The process of claim 12, in which the formed handle includes first and second handle members, the first handle member reversibly and adjustably mating to the second handle member.

20. A brush, comprising:

a brush member including a retaining portion and a first plurality of bristles extending from a lower surface of the retainer portion;

a first handle member and a second handle member, each of said first and second handle members integrally extending from the brush member, the first handle member reversibly and adjustably mating to the second handle member;

a generally concave brush cover defining a pair of laterally disposed slots, each of said slots accommodating one of said first and second handle members; and a sponge disposable in the retaining portion.

* * * * *

UNITED STATES PATENT AND TRADEMARK OFFICE

CERTIFICATE OF CORRECTION

PATENT NO. : 6,793,434 B1
DATED : September 21, 2004
INVENTOR(S) : Olson

It is certified that error appears in the above-identified patent and that said Letters Patent is hereby corrected as shown below:

Title page,
Item [76], Inventor, delete "MI" and insert -- MN --.

Column 1,
Line 47, delete "sectioning" and insert -- suctioning --.

Column 5,
Line 2, after "liquid.", begin a new paragraph.

Column 8,
Line 9, delete "infra" and insert -- infra --.

Column 9,
Line 63, delete "McGrawHill" and insert -- McGraw-Hill --.

Signed and Sealed this

Eighth Day of November, 2005

JON W. DUDAS
*Director of the United States Patent and Trademark Office*